US009567751B2

(12) United States Patent
Hewlett et al.

(10) Patent No.: US 9,567,751 B2
(45) Date of Patent: Feb. 14, 2017

(54) IMPALEMENT PREVENTION APPARATUS FOR EXTENDING OVERTOP OF AND AROUND THE EXPOSED ENDS OF A PLURALITY OF SPACED-APART REINFORCING BARS

(71) Applicant: 0971065 B.C. Ltd., Delta (CA)

(72) Inventors: Phil Hewlett, Delta (CA); Jim MacLean, Delta (CA)

(73) Assignee: 0971065 B.C. Ltd., Delta (CA)

( * ) Notice: Subject to any disclaimer, the term of this patent is extended or adjusted under 35 U.S.C. 154(b) by 0 days.

(21) Appl. No.: 14/823,846

(22) Filed: Aug. 11, 2015

(65) Prior Publication Data

US 2016/0186435 A1 Jun. 30, 2016

Related U.S. Application Data

(63) Continuation-in-part of application No. 14/071,389, filed on Nov. 4, 2013, now Pat. No. 9,133,636.

(51) Int. Cl.
*E04C 5/16* (2006.01)
*E04G 21/32* (2006.01)

(52) U.S. Cl.
CPC ..... *E04C 5/161* (2013.01); *E04C 5/168* (2013.01); *E04G 21/3252* (2013.01); *E04C 5/162* (2013.01); *E04G 21/32* (2013.01)

(58) Field of Classification Search
CPC ..... E04C 5/161; E04C 5/16; E04C 5/162; E04C 5/163; E04C 5/168; E04C 5/206; E04C 5/208; E04G 21/32
USPC ..... 52/300, 301; D25/135; 256/56, 65.12; 138/96 R, 117; 206/503, 504
See application file for complete search history.

(56) References Cited

U.S. PATENT DOCUMENTS

| | | | | |
|---|---|---|---|---|
| 4,202,378 | A | 5/1980 | Bush et al. | |
| 5,313,757 | A * | 5/1994 | Schnepf | E04C 5/161 138/96 R |
| 5,381,636 | A * | 1/1995 | Kassardjian | B29C 45/14065 138/96 R |
| 5,447,290 | A | 9/1995 | Workman | |
| 5,613,336 | A * | 3/1997 | Workman | E04C 5/161 52/301 |
| 5,943,836 | A | 8/1999 | Kassardjian | |
| 5,950,680 | A | 9/1999 | Randall | |
| 5,967,322 | A | 10/1999 | Apps et al. | |
| 6,017,014 | A | 1/2000 | Maguire | |
| 6,073,415 | A | 6/2000 | Carnicle | |

(Continued)

FOREIGN PATENT DOCUMENTS

CA 1085643 9/1980

OTHER PUBLICATIONS

International Search Report and Written Opinion for PCT/CA2014/051054, dated Mar. 3, 2015.

*Primary Examiner* — Babajide Demuren
(74) *Attorney, Agent, or Firm* — Cameron IP

(57) ABSTRACT

There is provided an impalement prevention apparatus. The apparatus includes an enclosure having a top and a pair of spaced-apart sides coupled to and extending downwards from the top. The enclosure has a pair of spaced-apart ends interposed between the sides and coupling to and extending downwards from the top. The sides of the enclosure are longer than the ends thereof. The enclosure includes an open bottom spaced-apart from and larger than the top. The enclosure tapers from the open bottom towards the top thereof.

19 Claims, 13 Drawing Sheets

(56) References Cited

U.S. PATENT DOCUMENTS

| | | | | |
|---|---|---|---|---|
| 6,085,478 | A | 7/2000 | Workman | |
| 6,199,333 | B1 | 3/2001 | Viduka | |
| 6,662,514 | B2 | 12/2003 | Workman | |
| 7,716,898 | B1 | 5/2010 | Dunn | |
| 7,784,615 | B2 | 8/2010 | Stahl | |
| 8,776,464 | B2 * | 7/2014 | Kassarjian | E04G 21/3252 138/96 R |
| 2005/0109653 | A1 | 5/2005 | Wnek et al. | |
| 2009/0107067 | A1 * | 4/2009 | Beery | E04C 5/161 52/301 |

* cited by examiner

IMPALEMENT PREVENTION APPARATUS FOR EXTENDING OVERTOP OF AND AROUND THE EXPOSED ENDS OF A PLURALITY OF SPACED-APART REINFORCING BARS

FIELD OF THE INVENTION

There is provided an impalement prevention apparatus. In particular, there is provided an impalement prevention apparatus for extending overtop of and around the exposed ends of a plurality of spaced-apart bars.

DESCRIPTION OF THE RELATED ART

U.S. Pat. No. 5,950,680 to Randall discloses an impalement protector for use in shielding protruding concrete reinforcing bars, typically found on construction sites. The impalement protector is used to prevent personal injuries caused by persons falling or otherwise coming into contact with the tips of the reinforcing bars. The impalement protector consists of an elongated U-shaped channel that is formed such that the free ends thereof are drawn together such that the impalement protector slides over the reinforcing bars, creating a friction fit therewith and securing itself thereto.

The above-described prior art may suffer from a number of disadvantages. The majority of people who fall at constructions sites may fall within a distance of ten vertical feet, and thus at an angle relative to the vertical axis. People who fall are thus more likely than not to fall at an angle. When said people fall onto the above-described device at an angle, the device may have a tendency to slide and expose the ends of the bars, thereby increasing the risk of impalement.

The above-described device may be relatively bulky for storage purposes and may be cumbersome to extend overtop of the bars.

There is accordingly a need for an improved impalement prevention device.

BRIEF SUMMARY OF INVENTION

There is provided an impalement prevention apparatus disclosed herein that overcomes the above disadvantages.

There is provided an impalement prevention apparatus. The apparatus includes an enclosure having a top and a pair of spaced-apart sides coupled to and extending downwards from the top. The enclosure has a pair of spaced-apart ends interposed between the sides and coupling to and extending downwards from the top. The sides of the enclosure are longer than the ends thereof. The enclosure includes an open bottom spaced-apart from and larger than the top. The enclosure tapers from the open bottom towards the top thereof.

There is also provided an impalement prevention apparatus having an enclosure. The enclosure includes a top and a pair of spaced-apart sides coupled to and extending downwards from the top. The enclosure includes a pair of spaced-apart ends interposed between the sides and coupling to and extending downwards from the top. The sides of the enclosure are longer than the ends thereof. The enclosure includes an interior and an open bottom spaced-apart from its top. The apparatus includes a reinforcement member for receiving exposed ends of a plurality of spaced-apart reinforcement bars. The reinforcement member is positioned within the interior of the enclosure. The reinforcement member is positioned adjacent to and is spaced-apart below the top of the enclosure.

There is further provided an impalement prevention apparatus. The apparatus includes an enclosure having a top and a pair of spaced-apart sides coupled to and extending downwards from the top. The enclosure includes a pair of spaced-apart ends interposed between the sides and coupling to and extending downwards from its top. The sides of the enclosure are longer than the ends thereof. The enclosure includes an interior and an open bottom spaced-apart from the top. The apparatus includes a pair of reinforcement members positioned within the interior of the enclosure. The reinforcement members include top portions which extend in parallel with the top of the enclosure and which are spaced-apart from each other.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
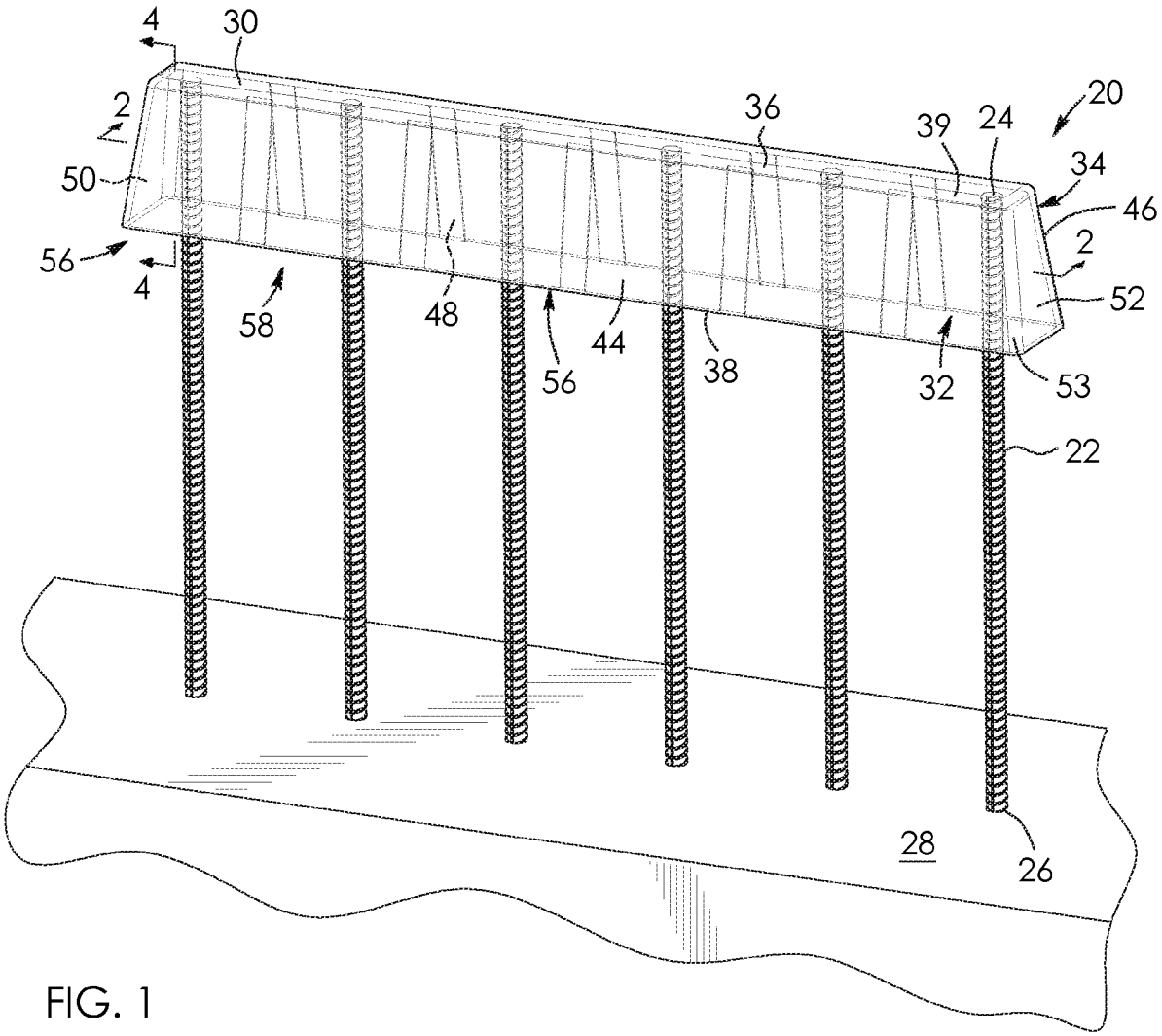
FIG. 1 is a top, side perspective view of an impalement prevention apparatus according to one aspect, shown extending around and overtop of the exposed ends of a plurality of spaced-apart bars.

Referring to the drawings and first to FIG. 1, there is shown an impalement prevention apparatus 20 for use with a plurality of spaced-part reinforcing bars 22 for concrete construction. Each bar has an exposed end 24 and a proximal end 26 which is spaced-apart from the exposed end. The proximal ends of the reinforcing bars are connected to a foundation, in this example a concrete foundation 28. The exposed ends 24 of the bars 22 are spaced-apart from the foundation.

The apparatus 20 is made of recycled plastic in this example, though this is not strictly required. The apparatus is made of polyethylene accordingly to one preferred aspect, though the apparatus can be made of other materials in other embodiments.

Figure 2:
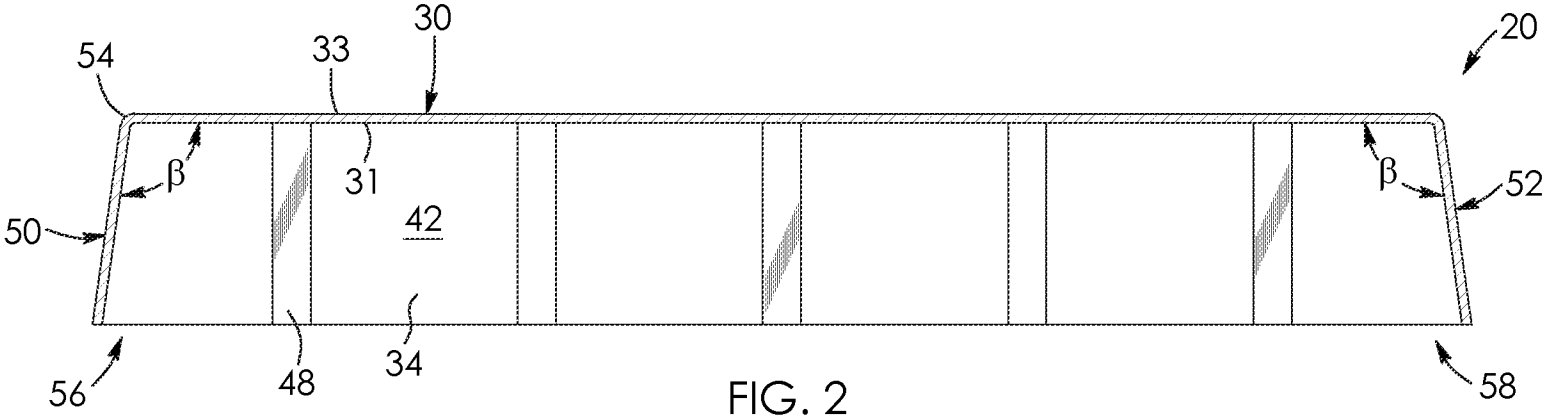
FIG. 2 is a sectional view taken along lines 2-2 of the apparatus of FIG. 1.
Figure 3:
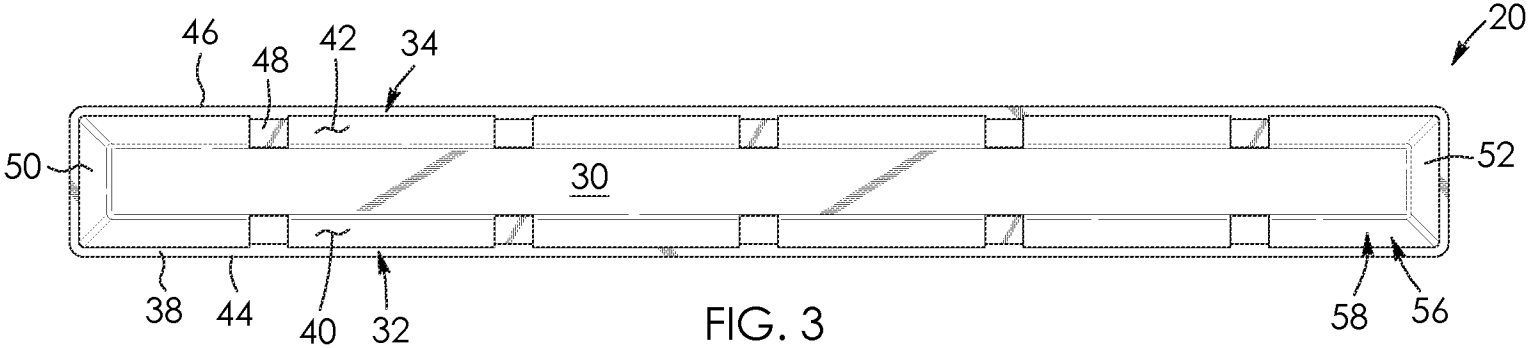
FIG. 3 is a bottom plan view of the apparatus of FIG. 1.

The apparatus 20 is in the form of a hollow housing and includes an elongate top portion 30 shaped to extend overtop of the exposed ends 24 of the reinforcing bars 22. The top portion is rectangular in shape in this example and, as seen in FIG. 2, has an inner surface 31 and an outer surface 33 spaced-apart from its inner surface The apparatus 20 includes a pair of elongate spaced-apart side portions 32 and 34. The side portions are isosceles trapezoids in shape in this example. Each of the side portions of the apparatus has a proximal end and a distal end spaced-apart from the proximal end, as shown by proximal end 36 and distal end 38 for side portion 32. The proximal ends of the side portions 32 and 34 connect to the top portion 30 of the apparatus 20 and extend downwards therefrom towards the proximal ends 26 of the reinforcing bars 22. The side portions of the apparatus connect to the top portion of the apparatus via rounded corners in this example, as shown by rounded corner 39 extending along and between side portion 32 and top portion 30 in FIG. 4.

Figure 4:
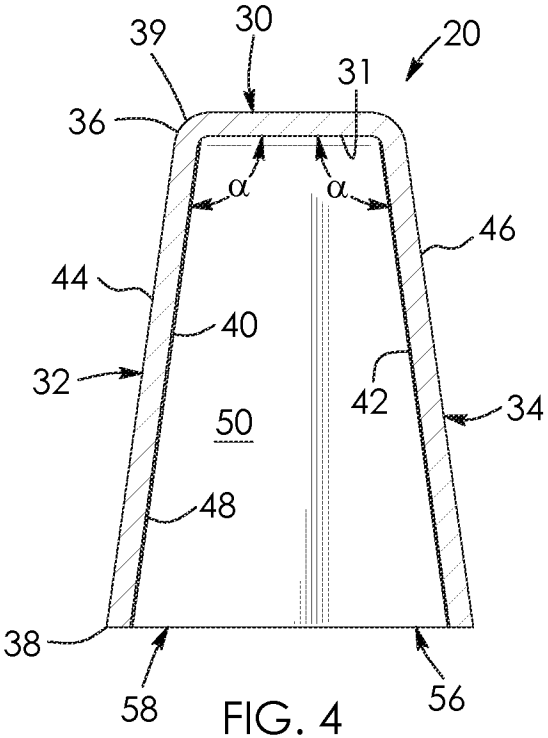
FIG. 4 is a sectional view taken along lines 4-4 of the apparatus of FIG. 1.

As best seen in FIG. 4, each of the side portions 32 and 34 of the apparatus 20 connects to and extends downwards from the top portion 30 thereof at an obtuse angle $\alpha$ relative to the inner surface 31 of the top portion in this example. Angles $\alpha$ are equal to each other in absolute value in this example and are equal to 100 degrees in this example. However, this is not strictly required and the angles may be other values in other embodiments.

The side portions 32 and 34 of the apparatus 20 have inner surfaces 40 and 42, respectively, which face each other. The side portions of the apparatus have outer surfaces 44 and 46, respectively, which are spaced-apart from the inner surfaces.

Figure 5:
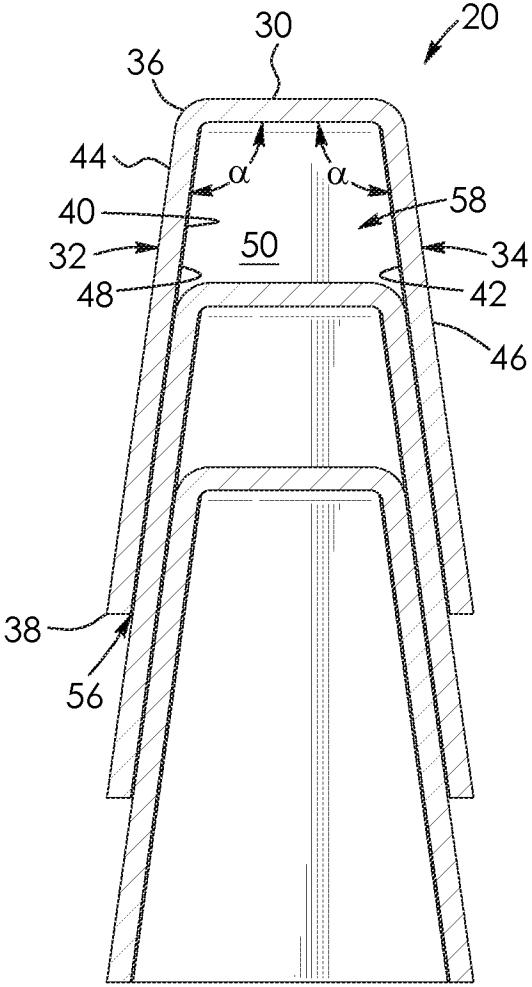
FIG. 5 is a sectional view similar to FIG. 4 of a plurality of impalement prevention apparatuses shown stacked together, each of the apparatuses being of the type shown in FIG. 1.

The apparatus 20 includes a plurality of stacking spacers, in this example, elongate strips 48. The strips are rectangular prisms in shape in this example. The strips 48 are connected to and spaced-apart along respective ones of the inner surfaces 40 and 42 of the side portions 32 and 34 of the apparatus. Each strip extends from a respective one of the proximal ends of the side portions to a respective one of the distal ends of the side portions, as shown in FIG. 4 by strip 48 extending between ends 36 and 38 of side portion 32 of the apparatus 20. As seen in FIG. 1, the strips 48 are positioned to be interposable between respective ones of the reinforcing bars. The strips 48 provide spacing between respective side portions of a plurality of apparatuses 20 when the apparatuses are stacked together, as seen in FIG. 5. Thus, when the apparatuses are wet, the strips inhibit the apparatuses so stacked from sticking together.

Referring back to FIG. 1, apparatus 20 includes a pair of spaced-apart end portions 50 and 52 each connecting to and extending between the side portions 32 and 34 thereof. The end portions are isosceles trapezoids in shape in this example, as best seen in FIG. 4 for end portion 50. The end portions of the apparatus 20 connect to the side portions of the apparatus via rounded corners, as shown by rounded corner 53 extending along and between end portion 52 and side portion 32 in FIG. 1. As seen in FIG. 1, the side portions 32 and 34 of the apparatus 20 are longer than the end portions 50 and 52 of the apparatus.

Referring to FIG. 2, each of the end portions 50 and 52 of the apparatus 20 connects to and extends downwards from the top portion 30 of the apparatus at an obtuse angle $\beta$ relative to the inner surface 31 of the top portion in this example. Angles $\beta$ are equal to each other in absolute value in this example. Angle $\beta$ is equal to 100 degrees in this example, though this is not strictly required and may be a different value in other embodiments. The end portions of the apparatus 20 connect to the top portion of the apparatus via rounded corners, as shown by rounded corner 54 extending along and between end portion 50 and top portion 30 in FIG. 2.

As seen in FIG. 1, the apparatus 20 includes an open end 56 spaced-apart from the top portion 30. The open end is rectangular in shape in this example and is larger than the top portion in this example. The apparatus 20 is tapered from the open end 56 towards the top portion thereof. The top portion 30, the side portions 32 and 34 and the end portions 50 and 52 of the apparatus form an enclosure 58 which is extendable around the exposed ends 24 of the reinforcing bars 22. The top portion 30, open end 56, side portions 32 and 34 and end portions 50 and 52 of the apparatus 20 may be referred to as the closed top, open bottom, sides and ends of the enclosure.

The end portions of the apparatus 20 are shaped to abut adjacent ones of the reinforcing bars when a person falls onto the apparatus at an angle. This may thereby ensure that the apparatus remains extended overtop of and around the exposed ends of the reinforcing bars. The apparatus 20 so shaped, with its rounded corners and outwardly protruding end portions 50 and 52 and side portions 32 and 34, may function to absorb this falling impact in a manner that protects and minimizes injury to the falling person.

As seen in FIG. 5, the enclosure 58 is further shaped to receive the side portions and the top portion of a further apparatus when stacking respective ones of the apparatuses 20 together. This may allow the apparatuses to be packed together in an efficient and cost-effective manner for storing and transporting purposes.

Figure 6:
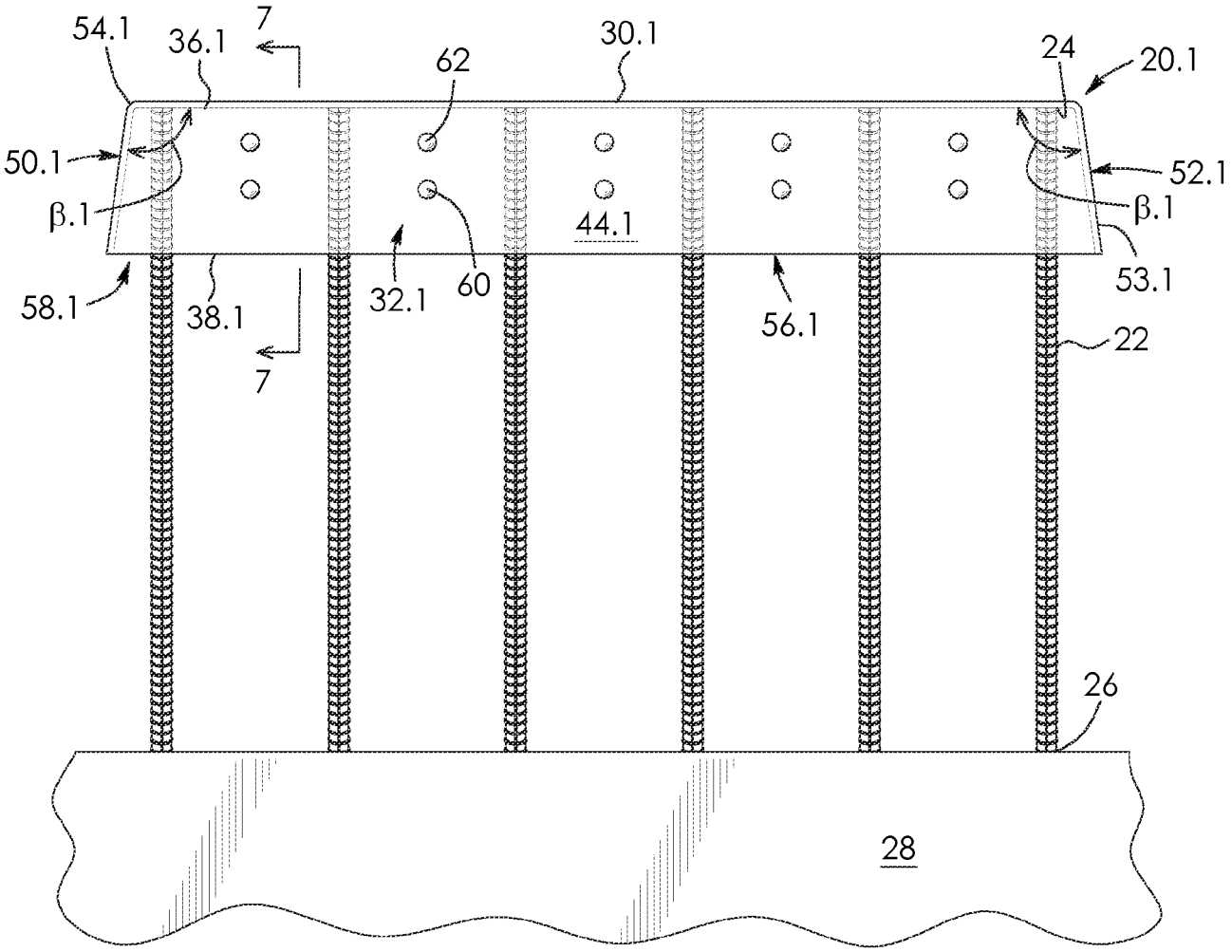
FIG. 6 is a side elevation view of an impalement prevention apparatus according to a second aspect, shown extending around and overtop of the exposed ends of a plurality of spaced-apart bars.
Figure 7:
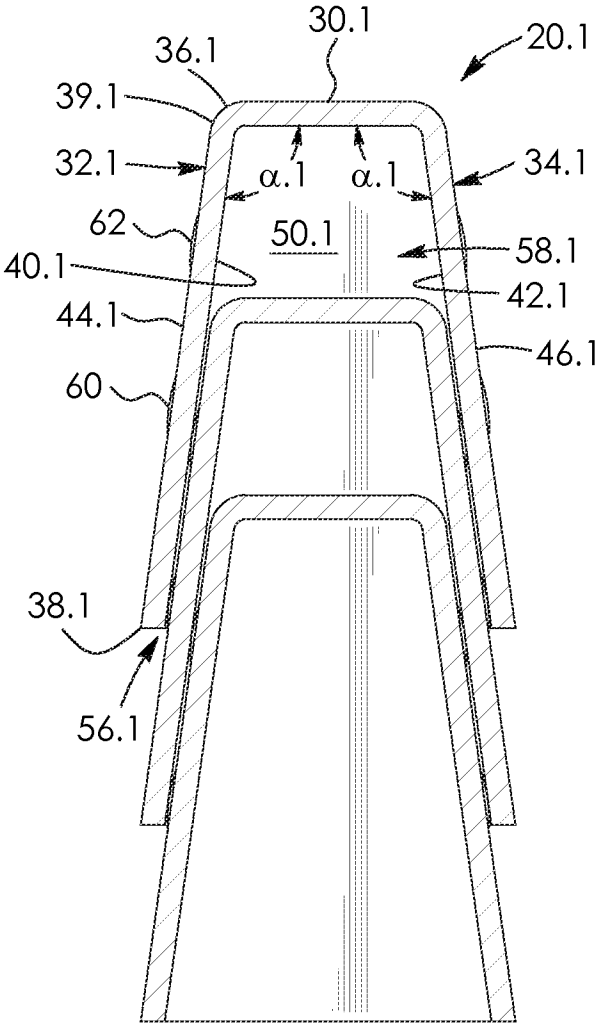
FIG. 7 is a sectional view similar to FIG. 5 of a plurality of impalement prevention apparatuses shown in sectional view and shown stacked together, each of the apparatuses being of the type shown in FIG. 6.

FIGS. 6 and 7 show an impalement prevention apparatus 20.1 according to a second aspect. Like parts have like numbers and functions as the impalement prevention apparatus 20 shown in FIGS. 1 to 5 with the addition of "0.1". Apparatus 20.1 is substantially the same as apparatus 20 shown in FIGS. 1 to 5 with the exception that the spacers are in the form of pairs of spaced-apart, partially-spherical, convexly curved protrusions in this example, as seen by protrusions 60 and 62. The protrusions connect to and extend outwards from the outer surfaces of the side portions, as seen by protrusions 60 and 62 connecting to and extending outwards from the outer surface 44.1 of side portion 32.1 of apparatus 20.1.

Figure 9:
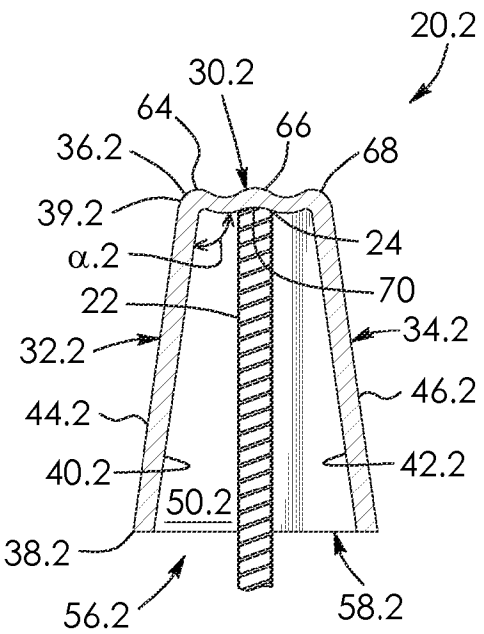
FIG. 9 is a sectional view similar to FIG. 5 of a plurality of impalement prevention apparatuses shown in section and shown stacked together, each of the apparatuses being of the type shown in FIG. 8.
Figure 8:
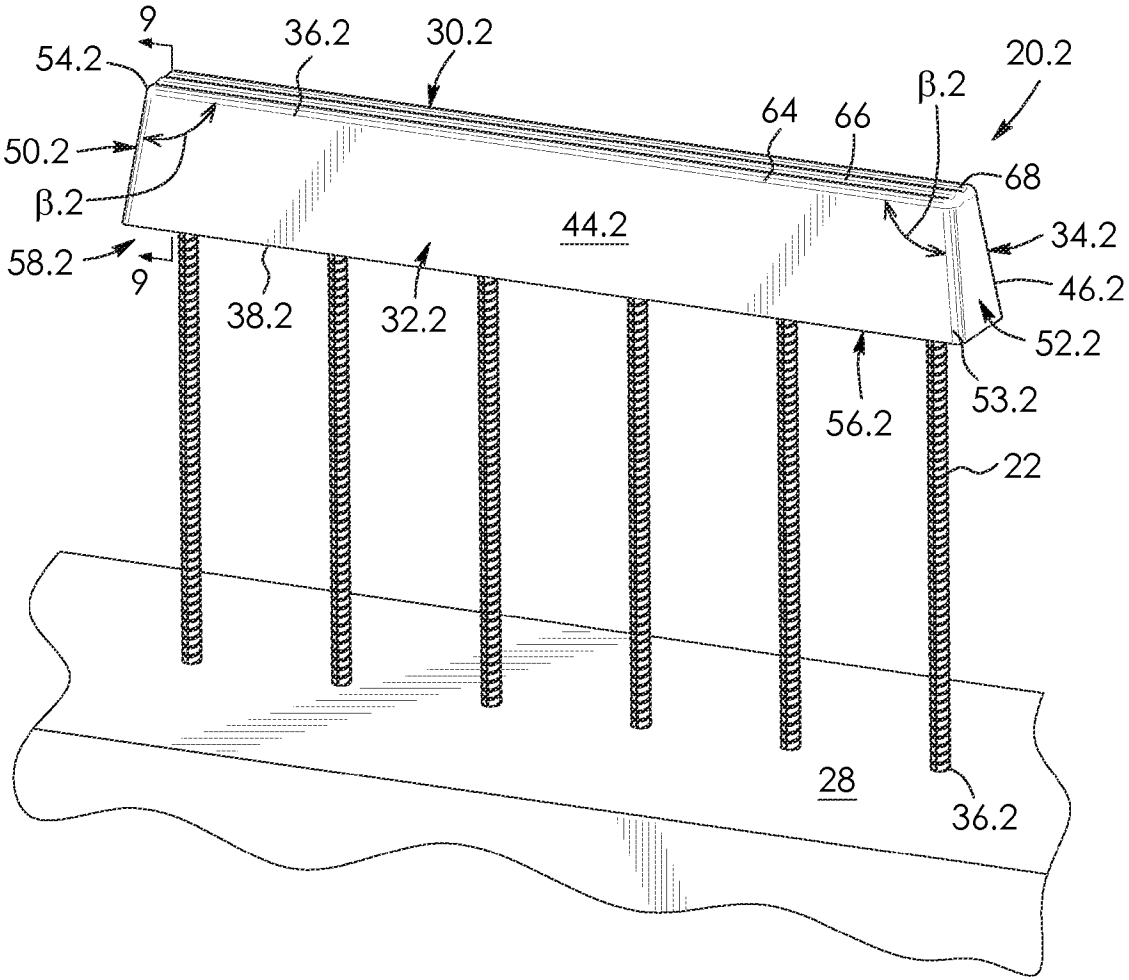
FIG. 8 is a top, side perspective view of an impalement prevention apparatus according to a third aspect, shown extending around and overtop of the exposed ends of a plurality of spaced-apart bars.

FIGS. 8 and 9 show an impalement prevention apparatus 20.2 according to a third aspect. Like parts have like numbers and functions as the impalement prevention apparatus 20 shown in FIGS. 1 to 5 with the addition of "0.2". Apparatus 20.2 is substantially the same as apparatus 20 shown in FIGS. 1 to 5 with the following exceptions. Top portion 30.2 of the apparatus includes a plurality of space-apart elongate ribs, in this example three ribs 64, 66 and 68 as best seen in FIG. 9. The ribs may function to strengthen the top portion of the apparatus 20.2 in a manner that minimizes materials and weight. According to one preferred aspect, the apparatus 20.2 is injection molded. By providing ribs 64, 66 and 68, top portion 30.2 of the apparatus may be made thinner, thereby facilitating the injection molding process.

The top portion of the apparatus 20.2 includes a central elongate groove 70 on the inner surface 31.2 thereof which is shaped to receive respective ones of the exposed ends 24 of the reinforcing bars 22. The groove aligns adjacent to and parallel with central rib 66 in this example. The ribs 64, 66, and 68 are made, in this example, by forming the top portion in a waved manner, with the groove 70 being also formed thereby.

FIGS. 10 to 15 show an impalement prevention apparatus 20.3 according to a fourth aspect. Like parts have like numbers and functions as the impalement prevention apparatus 20.2 shown in FIGS. 6 and 7 with decimal extension "0.3" replacing decimal extension "0.2". Apparatus 20.3 is substantially the same as apparatus 20.2 shown in FIGS. 6 and 7 with the following exceptions.

Figure 10:
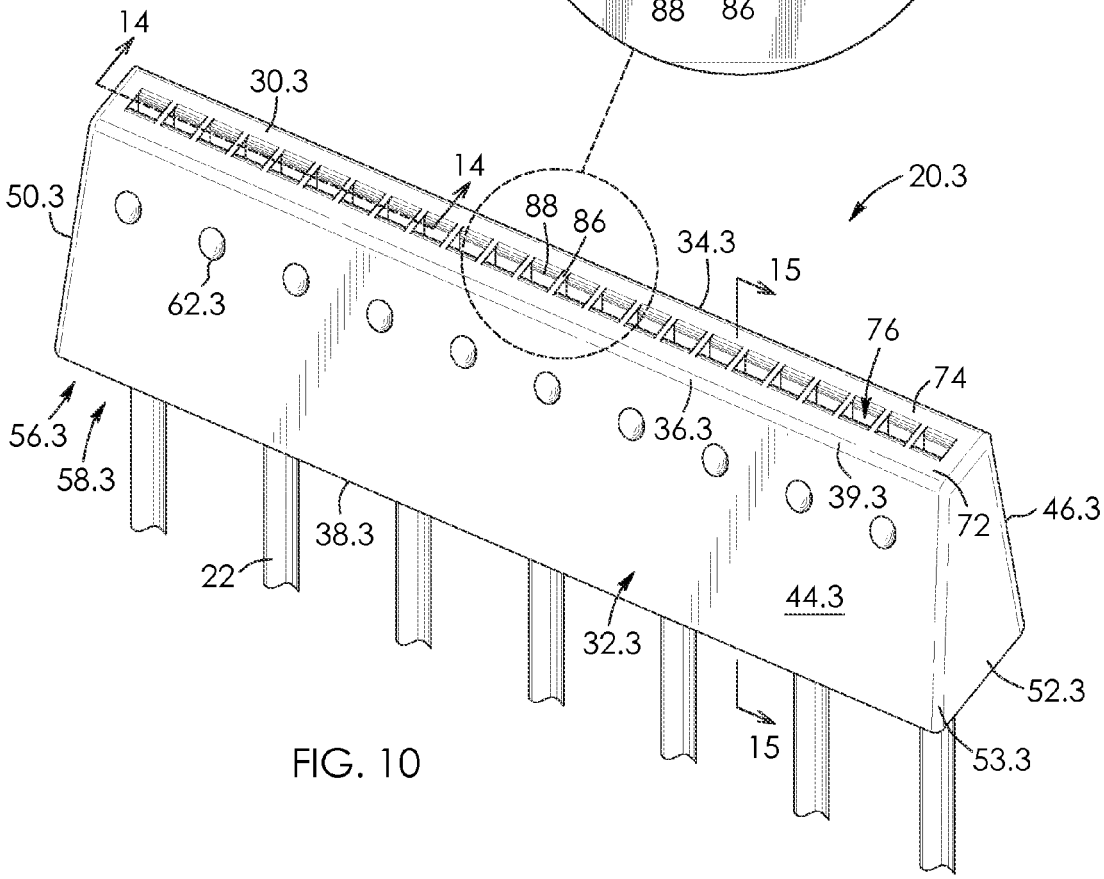
FIG. 10 is a top, side perspective view of an impalement prevention apparatus according to a fourth aspect.
Figure 12:
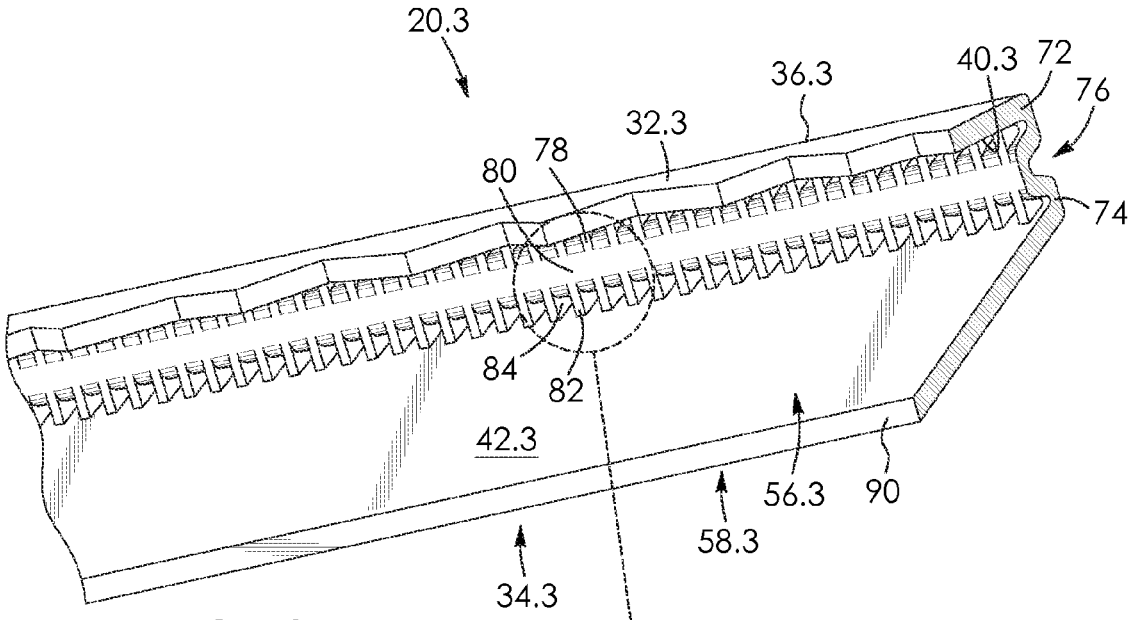
FIG. 12 is a bottom, side perspective view of the apparatus of FIG. 10, the apparatus being partially broken away.
Figure 15:
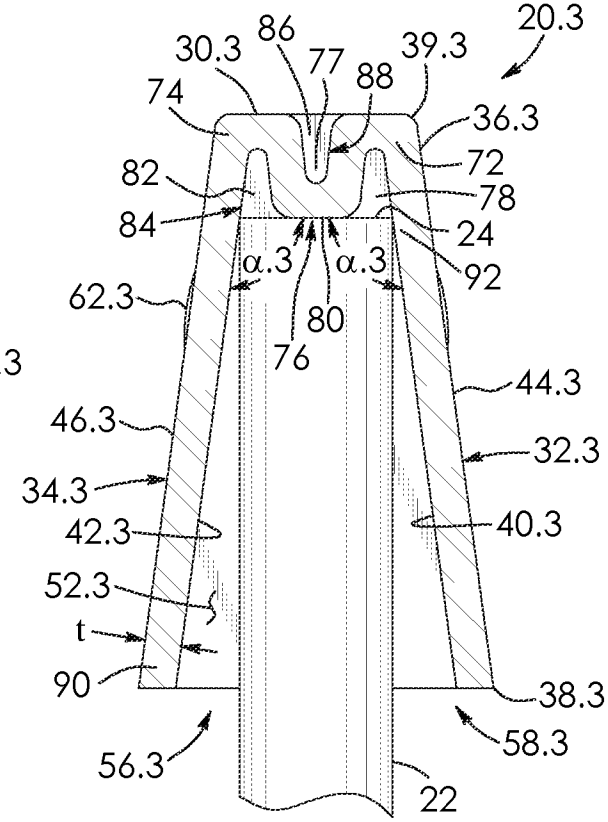
FIG. 15 is a side-sectional view of the apparatus of FIG. 10 taken along lines 15-15 of the apparatus of FIG. 10.

Top portion 30.3 of the apparatus includes a pair of spaced-apart longitudinal ridges 72 and 74, best seen with reference to FIGS. 10, 12 and 15, positioned adjacent to respective ones of the side portions 32.3 and 34.3 of the apparatus 20.3. The ridges are flat-topped in this example, though this is not strictly required. Top portion 30.3 of apparatus 20.3 includes an elongate trough 76, best seen in FIGS. 12 and 15, positioned between the ridges 72 and 74. The trough has a central depression 77 extending downwards from the top portion 30.3 of the apparatus. As seen in FIG. 10, ridges 72 and 74 and trough 76 connect to and extend between end portions 50.3 and 52.3 of the apparatus 20.3. Referring to FIG. 12, the trough extends downwards into enclosure 58.3 and is positioned between the side portions 32.3 and 34.3 of the apparatus.

Figure 13:
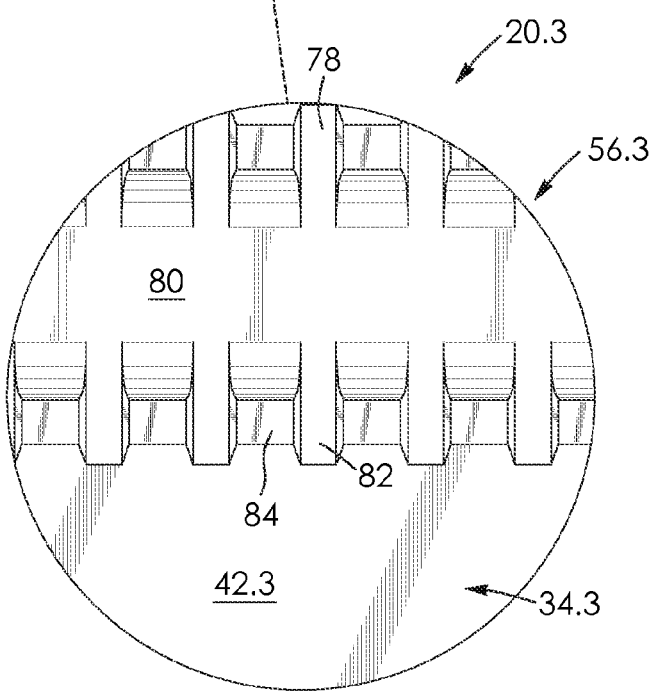
FIG. 13 is an enlarged bottom plan view of part of the top portion of the apparatus of FIG. 10.

As best seen in FIGS. 12, 13 and 15, the apparatus 20.3 includes a plurality of longitudinally spaced-apart webs that connect to and extend between the trough and respective ones of the side portions of the apparatus. This is shown in FIG. 15 by web 78 extending between side portion 32.3 and trough 76, and web 82 extending between side portion 34.3 and trough 76. The webs thus connect to and extend between the side portions 32.3 and 34.3 of the apparatus 20.3. The webs 78 and 82 also connect to and extend downwards from the top portion 30.3 of the apparatus to the bottom 80 of the trough 76 in this example. Portions 79 of the apparatus 20.3 peripheral to and adjacent to each of the webs comprise a generally inverted u-shape in this example as best seen in FIG. 15. As best seen in FIGS. 12 and 13, the apparatus 20.3 also includes a plurality of spaced-apart recesses 84 positioned between adjacent webs. The recesses are generally in the shape of triangular prisms in this example.

Figure 11:
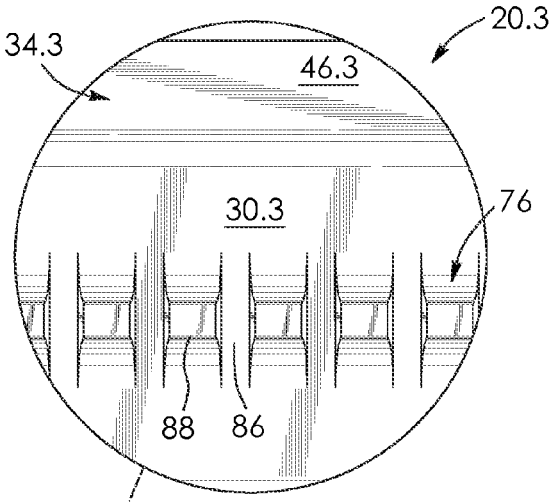
FIG. 11 is an enlarged top plan view of part of the top portion of the apparatus of FIG. 10.
Figure 14:
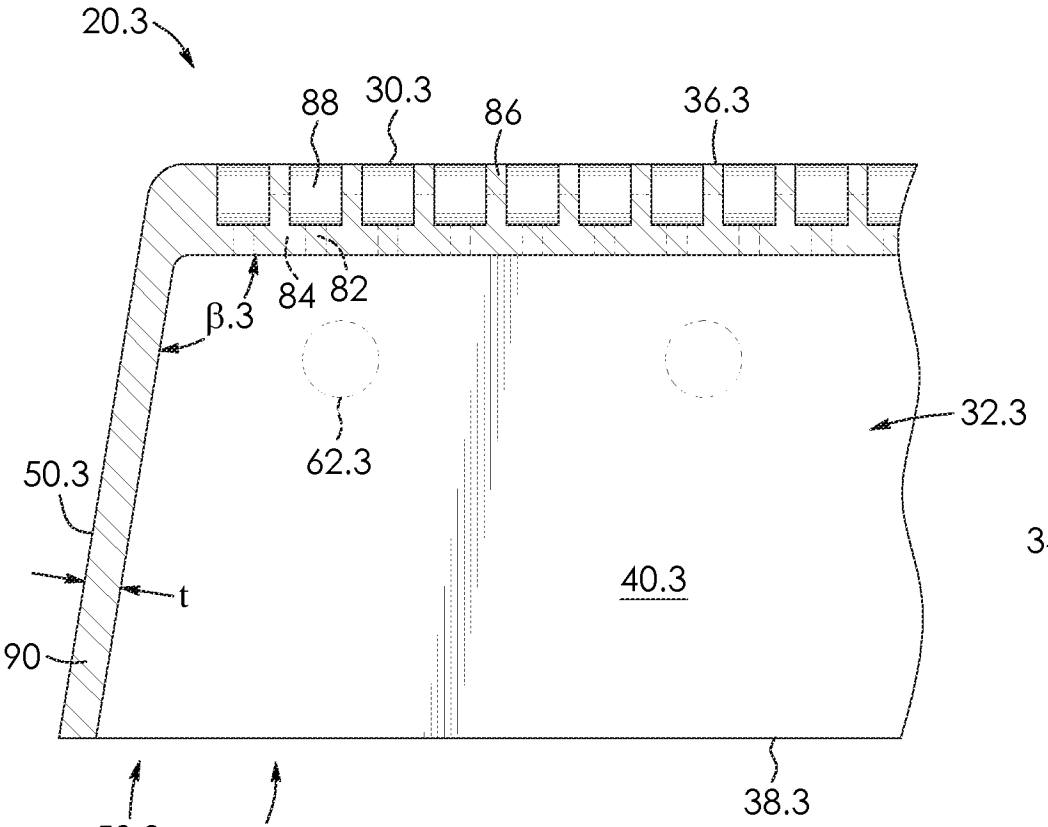
FIG. 14 is a cross-sectional view of the apparatus of FIG. 10 taken along lines 14-14 of the apparatus of FIG. 10.

Referring now to FIGS. 10, 11 and 15, the apparatus 20.3 includes a plurality of longitudinally spaced-apart, lateral ribs 86 positioned within the trough 76 and which connect to and extend between the ridges 72 and 74. The ribs are generally u-shaped in shape in this example as best seen in FIG. 15. As seen in FIG. 14, in this example, ribs 86 are longitudinally spaced-apart and interposed between webs 82. Referring back to FIG. 10, the apparatus 20.3 includes a plurality of spaced-apart recesses 88 positioned between respective ones of its ribs. The recesses are generally in the shape of triangular prisms in this example with square outer ends.

Side portions 32.3 and 34.3, top portion 30.3 and end portions 50.3 and 52.3 of the apparatus 20.3 are formed by sheet members 90 of substantially the same thickness t, as best seen in FIGS. 14 and 15. The apparatus 20.3 so shaped, with its ridges and trough, enables the apparatus to be molded in an efficient manner that inhibits warping, while also providing an effectively thicker and stronger top portion 30.3. Webs 78 and 82 and ribs 86 may further enhance the weight-bearing strength of top portion 30.3. Also, the webs and ribs, together with recesses 84 and 88 and sheet members 90 of the same thickness, may promote effective forming of the apparatus and subsequent cooling during the manufacture of the apparatus.

As seen in FIG. 15, apparatus 20.3 in this example is shaped to snugly receive the exposed ends 24 of the reinforcing bars 22 between the side portions 32.3 and 34.3 thereof. In this case, the ends of the reinforcing bars are fitted between the side portions of the apparatus at a location 92 which is adjacent to where the side portions of the apparatus connect with the top portion 30.3 of the apparatus.

Figure 17:
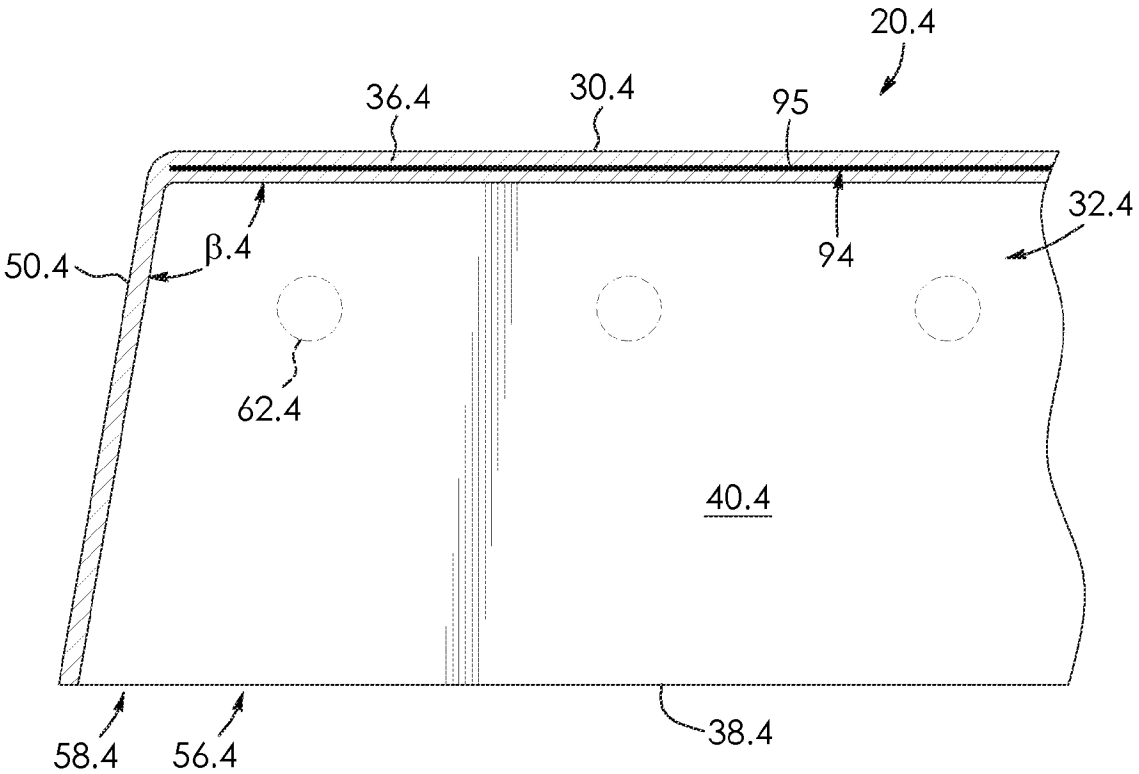
FIG. 17 is a side-sectional view similar to FIG. 15 of the apparatus of FIG. 16.
Figure 16:
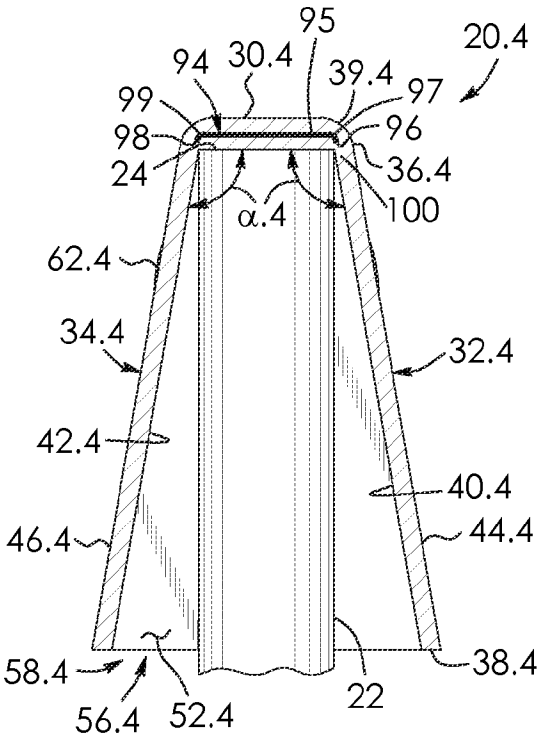
FIG. 16 is a cross-sectional view similar to FIG. 14 of an impalement prevention apparatus according to a fifth aspect.

FIGS. 16 and 17 show an impalement prevention apparatus 20.4 according to a fifth aspect. Like parts have like numbers and functions as the impalement prevention apparatus 20 shown in FIGS. 1 to 5 with the addition of decimal extension "0.4". Apparatus 20.4 is substantially the same as apparatus 20 shown in FIGS. 1 to 5 with the following exceptions.

Apparatus 20.4 is primarily made of plastic, in this example polyethylene, though this is not strictly required and other materials may be used. The apparatus in this embodiment further includes a strengthening member, in this example a strengthening plate in the form of a metal plate 94. The plate is made of steel in this example and is u-shaped in cross-section in this example. The plate is embedded within the top portion of the apparatus in this example. The plate 94 includes a top portion 95 which connects to, aligns with and extends along the top portion 30.4 of the apparatus 20.4. The top portion of the plate is a rectangular prism in shape in this example. The plate 94 includes a pair of spaced-apart longitudinally-extending side portions 97 and 99 extending partially downwards from the top portion 95 of the plate. The side portions of the plate are curved and downwardly-concave in this example, and align adjacent to respective one of the side portions 32.4 and 34.4 of the apparatus 20.4 in this example. The side portions 97 and 99 of the plate 94 terminate at longitudinally-extending peripheral edges 96 and 98 in this example which abut with and are embedded within side portions 32.4 and 34.4 of the apparatus 20.4, respectively, adjacent to corners 39.4 of the apparatus.

As seen in FIG. 16, ends 24 of the reinforcing bars 22 are snugly received between side portions 32.4 and 34.4 of the apparatus 20.4 at a location 100 adjacent to where the side portions of the apparatus connect with the top portion 30.4 of the apparatus.

Figure 18:
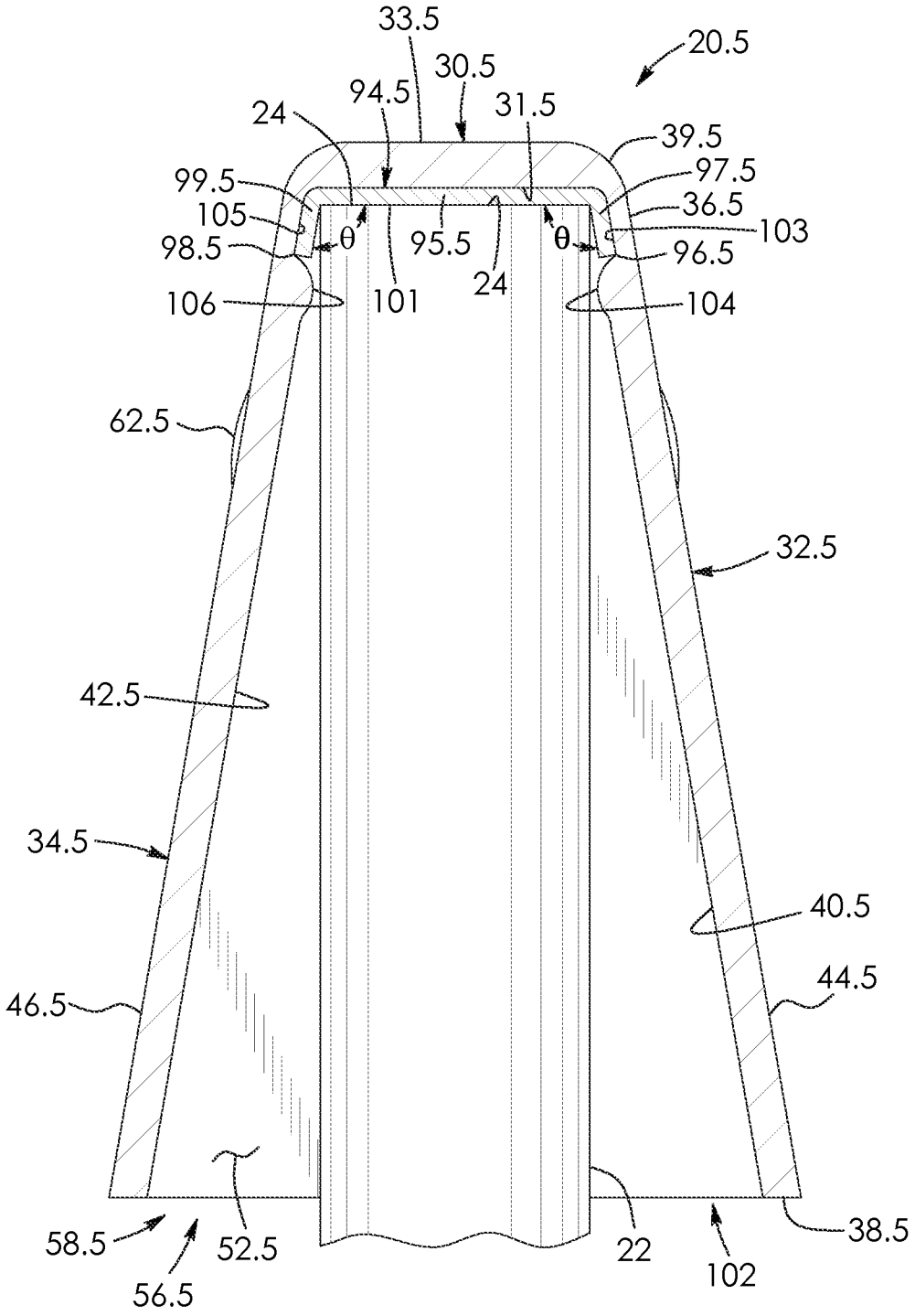
FIG. 18 is a cross-sectional view similar to FIG. 16 of an impalement prevention apparatus according to a sixth aspect.

FIG. 18 shows an impalement prevention apparatus 20.5 according to a sixth aspect. Like parts have like numbers and functions as the impalement prevention apparatus 20.4 shown in FIGS. 16 and 17 with decimal extension "0.5" replacing decimal extension "0.4" and being added for numerals not previously having a decimal extension. Apparatus 20.5 is substantially the same as apparatus 20.4 shown in FIGS. 16 and 17 with the following exceptions.

The apparatus has an interior 102, which may also be said to be the interior of the enclosure 58.5. The apparatus 20.5 further includes a pair of spaced-apart protrusions 104 and 106 positioned within the interior of the apparatus. The protrusions are longitudinally extending in this example, extending between the end portions of apparatus, though this is not strictly required. Protrusion 104 extends outwards from inner surface 40.5 of side portion 32.5 of the apparatus 20.5 and protrusion 106 extends outwards from inner surface 42.5 of side portion 34.5 of the apparatus. The protrusions are positioned adjacent to and spaced-apart from the top portion 30.5 of the apparatus 20.5. The apparatus 20.5 includes longitudinally-extending recesses 103 and 105 positioned between the top portion 30.5 of the apparatus and the protrusions 104 and 106. The protrusions 104 and 106 are partially-spherical and have convexly curved outer surfaces 107 and 109 in this example. Plate 94.5 abuts inner surface 31.5 of top portion 30.5 of the apparatus 20.5. The plate is retained in place between the top portion of the apparatus and the protrusions 104 and 106, with side portions 97.5 and 99.5 of the plate 94.5 fitting within recesses 103 and 105, respectively. In one example, plate 94.5 is installed by being pushed past protrusions 104 and 106 and towards inner surface 31.5 of top portion 30.5 of the apparatus when the apparatus has recently come out of the mold and is thus still malleable, with the plate thus being pressed or snapped into place.

Side portions 97.5 and 99.5 of the plate 94.5 are rectangular prisms in shape in this example. The side portions of the plate align adjacent to and extend in parallel with respective one of the side portions 32.5 and 34.5 of the apparatus 20.5 in this example. The plate 94.5 is bent out of plane longitudinally at side portions 97.5 and 99.5 thereof in this example towards the pair of spaced-apart longitudinal edges 96.5 and 98.5 such that the side portions 97.5 and 99.5 of the strengthening plate run along both the sides portions 32.5 and 34.5 of the apparatus from the bent portions to the edges 96.5 and 98.5 and extend over the exposed ends 24 of the bars 22. Top portion 95.5 of plate 94.5 has a lower surface 101. Each of the side portions 97.5 and 99.5 of the plate 94.5 connects to and extends downwards from the top portion 95.5 thereof at an obtuse angle θ relative to the inner surface lower surface 101 of the top portion 95.5 in this example. Angles θ are equal to each other in absolute value in this example.

Also as seen in FIG. 18, longitudinal edges 96.5 and 98.5 of the plate 94.5 extend in parallel with respective ones of the side portions 32.5 and 34.5 of the apparatus 20.5 in this example. Edges 96.5 and 98.5 of the plate abut protrusions 104 and 106, respectively, when the plate is so positioned in place.

FIGS. 19 to 24 show an impalement prevention apparatus 20.6 according to a seventh aspect. Like parts have like numbers and functions as the impalement prevention apparatus 20.5 shown in FIG. 18 with decimal extension "0.6" replacing decimal extension "0.5" and being added for numerals not previously having a decimal extension. Apparatus 20.6 is substantially the same as apparatus 20.5 shown in FIG. 18 with the following exceptions.

Figure 19:
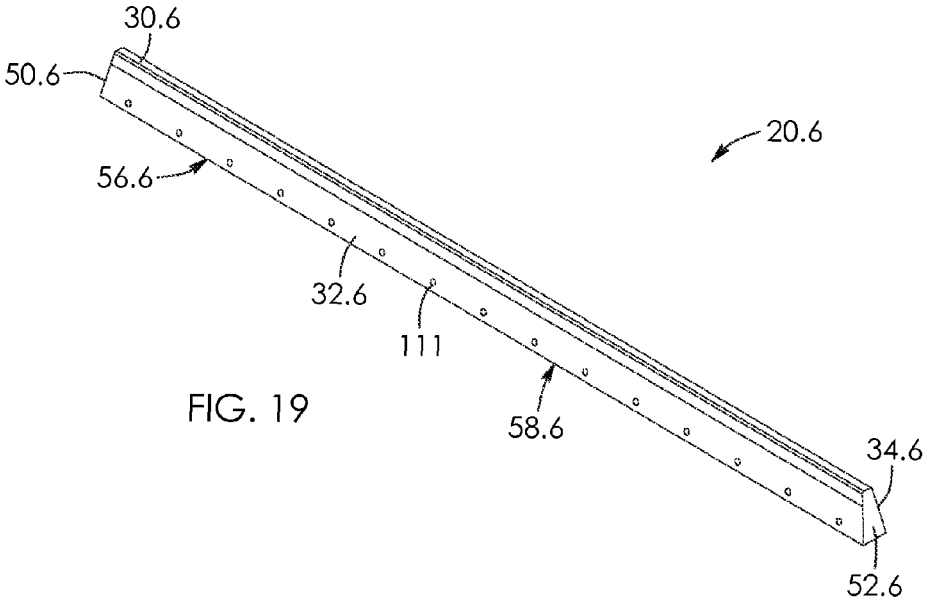
FIG. 19 is a top, side perspective view of an impalement prevention apparatus according to a seven aspect.
Figure 20:
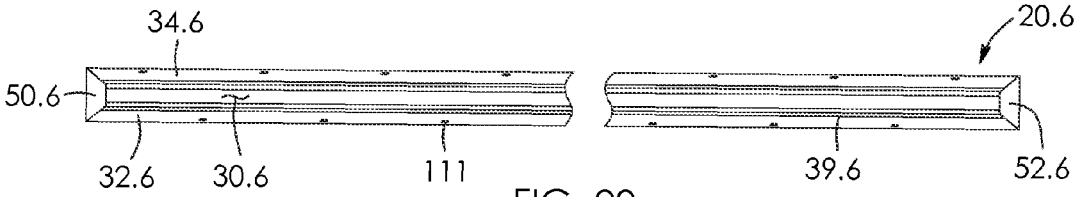
FIG. 20 is a top plan view thereof, the full length of the apparatus not being shown.
Figure 21:
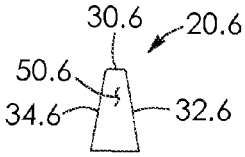
FIG. 21 is a left end elevation view of the apparatus of FIG. 19, with the right end elevation view being a mirror image thereof.
Figure 22:
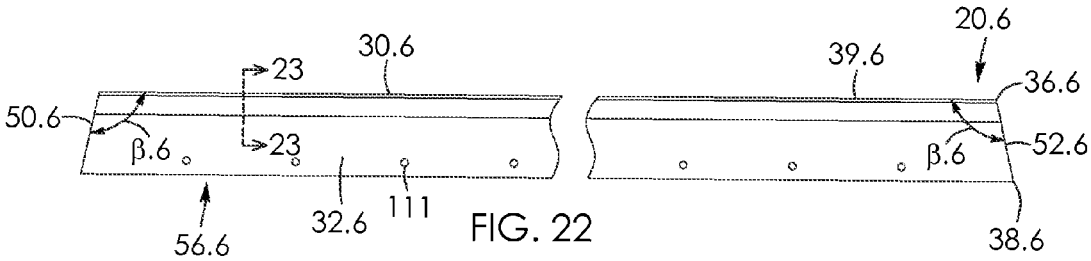
FIG. 22 is a first side elevation view of the apparatus of FIG. 19, the full length of the apparatus not being shown and with the second side elevation view being a mirror image thereof.

As seen in FIG. 19, apparatus 20.6 includes a plurality of longitudinally spaced-apart apertures extending through respective ones of the side portions of the apparatus, as seen by aperture 111 extending through side portion 32.6 thereof. The apertures align adjacent to the distal ends 38.6 of the side portions 32.6 and 34.6 of the apparatus 20.6 and may be used to further secure the apparatus 20.6 in place with rope, wire or the like (not shown) if desired.

Figure 23:
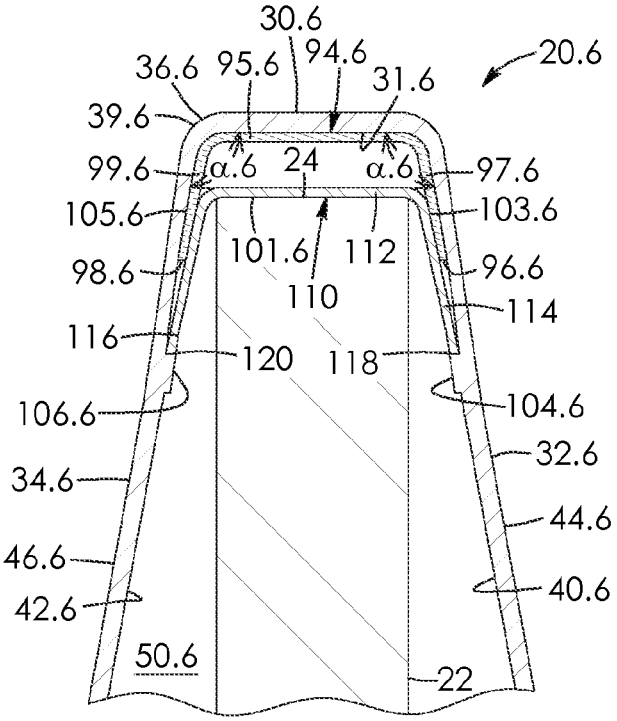
FIG. 23 is a section view taken along lines 23-23 of the apparatus shown in FIG. 22.

As seen in FIG. 23, top portion 95.6 of plate 94.6 aligns with and extends along the inner surface 31.6 of the top portion 30.6 of the apparatus 20.6. Side portions 97.6 and 99.6 of plate 94.6 each align with and partially extend along respective one of the side portions 32.6 and 34.6 and fit within recesses 103.6 and 105.6, respectively.

Apparatus 20.6 includes a second strengthening member, in this example a strengthening plate in the form of a metal plate 110. Plates 94.6 and 110 are substantially similar in shape and parts in this example. Plate 110 includes a top portion 112 spaced-apart below the top portion 95.6 of plate 94.6 as seen in FIG. 23. The top portion of plate 110 is spaced-apart below and extends in parallel with the top portion 30.6 of the apparatus 20.6. Plate 110 includes a pair of spaced-apart side portions 114 and 116 whose upper parts abut the side portions 97.6 and 99.6 of plate 94.6 in this example. The plates are thus spaced-apart from each other at least in part. Side portions 114 and 116 of plate 110 terminate at longitudinally-extending edges 118 and 120 which are shaped to abut protrusions 104.6 and 106.6. In this manner, plate 94.6 abuts inner surface 31.6 of top portion 30.6 of apparatus 20.6 and is received by recesses 103.6 and 105.6 and plate 110 is received by and interposed between plate 94.6 and protrusions 104.6 and 106.6.

Figure 24:
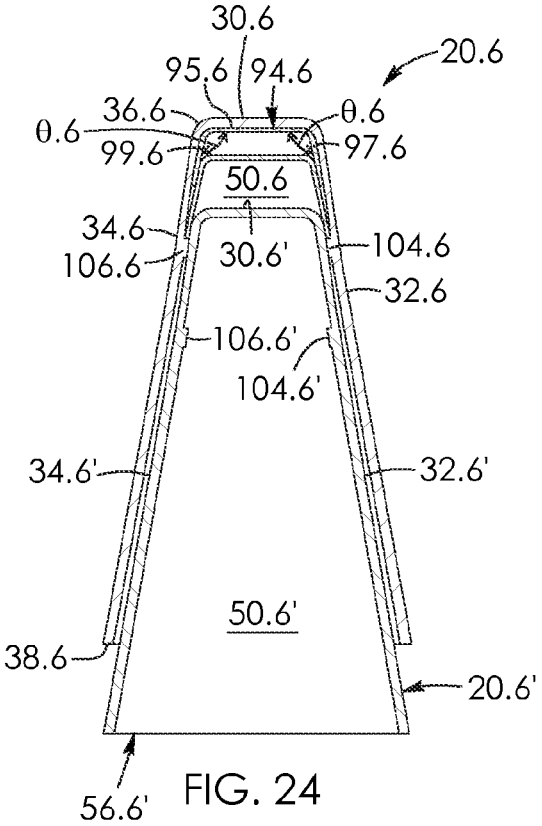
FIG. 24 is a cross-sectional view of a pair of impalement prevention apparatuses of the type shown in FIG. 19, the apparatuses being shown stacked together.

Providing a pair of plates 94.6 and 110 may be more economical to manufacture compared to a single plate having twice the thickness. Also, providing two plates one of which being spaced-apart from the other may result in greater cushioning and impact absorption for inhibiting impalement should a person hit the top portion 30.6 of the apparatus 20.6. As seen in FIG. 24, apparatuses 20.6 and 20.6' are shaped to be stackable with each other.

The top portion, side portions and end portions of the various embodiments of the apparatus described herein may be referred to as a means for forming an enclosure extendable around the exposed ends of the bars.

It will be appreciated that many variations are possible within the scope of the invention described herein. It will be understood by someone skilled in the art that many of the details provided above are by way of example only and are not intended to limit the scope of the invention which is to be determined with reference to at least the following claims.

What is claimed is:

1. An impalement prevention apparatus for use with a plurality of spaced-part reinforcing bars having exposed ends, the apparatus comprising:

an enclosure shaped to extend over and at least partially enclose the exposed ends of the bars, the enclosure including a top, a pair of spaced-apart sides coupled to and extending downwards from the top of the enclosure, a pair of spaced-apart ends interposed between the sides of the enclosure and coupling to and extending downwards from the top of the enclosure, the sides of the enclosure being longer than the ends thereof, and an open bottom spaced-apart from and larger than the top of the enclosure, the enclosure tapering from the open bottom towards the top thereof; and a pair of reinforcement members that are u-shaped in cross-section, each said reinforcement member including a top portion and including a pair of spaced-apart side portions aligning with and at least partially extending along respective ones of the sides of the enclosure, a first of the reinforcement members aligning with and extending along an inner surface of the top of the enclosure and receiving a top portion of a second of the reinforcement members, the top portion of the second of the reinforcement members being spaced-part below the top portion of the first of the reinforcement members.

2. The apparatus as claimed in claim 1 wherein the sides and the ends of the enclosure are generally in the shape of isosceles trapezoids.

3. The apparatus as claimed in claim 1 wherein the apparatus further includes a plurality of longitudinally spaced-apart apertures extending through the sides of the enclosure.

4. The apparatus as claimed in claim 1 wherein the apparatus is made of plastic, and wherein the reinforcement members are metal plate.

5. The apparatus as claimed in claim 1 wherein each of the sides of the enclosure further includes a longitudinally-extending recess adjacent to and extending downwards from the inner surface of the top of the enclosure and wherein at least one of the reinforcement members is shaped to be received in part within said recesses.

6. The apparatus as claimed in claim 1, wherein the enclosure has an interior and wherein the apparatus further includes a pair of spaced-apart protrusions positioned within the interior of the enclosure, the protrusions extending outwards from respective ones of the sides of the enclosure, and wherein the reinforcement members are interposed between and retained in place by the protrusions and the top of the enclosure.

7. In combination, a plurality of bars and the apparatus as claimed in claim 1.

8. The apparatus as claimed in claim 1 wherein the ends and the sides of the enclosure extend downwards from the top of the enclosure at obtuse angles relative to the inner surface of the top of the enclosure.

9. The apparatus as claimed in claim 1 and a further apparatus, wherein the apparatuses are substantially the same and stackable with each other, with the enclosure of a first of the apparatuses being shaped to receive the top and at least part of the sides of the enclosure of a second of the apparatuses when stacking respective ones of the apparatuses together.

10. An impalement prevention apparatus comprising:

an enclosure having a top, a pair of spaced-apart sides coupled to and extending downwards from the top, a pair of spaced-apart ends interposed between the sides and coupling to and extending downwards from the top, the sides of the enclosure being longer than the ends thereof, an interior, and an open bottom spaced-apart from the top, the top of the enclosure having an inner surface in communication with the interior of the enclosure; and a pair of u-shaped reinforcement members positioned within the interior of the enclosure, the reinforcement members including top portions which are spaced-apart from each other, the top portion of a first of the reinforcement members abutting the inner surface of the top of the enclosure, the first of the reinforcement members including a pair of spaced-apart side portions which abut the sides of the enclosure, the top portion of a second of the reinforcement members being spaced-apart below the top portion of the first of the reinforcement members, and the second of the reinforcement members including a pair of spaced-apart side portions which abut respective ones of the side portions of the first of the reinforcement members.

11. The apparatus as claimed in claim 10 wherein the ends and the sides of the enclosure extend downwards from the top of the enclosure at obtuse angles relative to the inner surface of the top of the enclosure.

12. The apparatus as claimed in claim 10 wherein the sides and the ends of the enclosure are generally in the shape of isosceles trapezoids.

13. The apparatus as claimed in claim 10 and a further apparatus, wherein the apparatuses are substantially the same and stackable with each other, with the enclosure of a first of the apparatuses being shaped to receive the top and at least part of the sides of the enclosure of a second of the apparatuses when stacking respective ones of the apparatuses together.

14. An impalement prevention apparatus comprising:

an enclosure having a top, a pair of spaced-apart sides coupled to and extending downwards from the top, a pair of spaced-apart ends interposed between the sides and coupling to and extending downwards from the top, the sides of the enclosure being longer than the ends thereof, an interior, and an open bottom spaced-apart from the top, the top of the enclosure having an inner surface in communication with the interior of the enclosure; and a pair of u-shaped reinforcement members a first of which abutting and extending along the top and the sides of the enclosure, and a second of which including side portions abutting the sides of the enclosure and including a top portion received by said first of the reinforcement members.

15. The apparatus as claimed in claim 14 wherein the ends and the sides of the enclosure extend downwards from the top of the enclosure at obtuse angles relative to the inner surface of the top of the enclosure.

16. The apparatus as claimed in claim 14 wherein the side portions of the second of the reinforcement members extend downwards from the top portion of the second of the reinforcement members.

17. The apparatus as claimed in claim 14 wherein the sides and the ends of the enclosure are generally in the shape of isosceles trapezoids.

18. The apparatus as claimed in claim 14 and a further apparatus, wherein the apparatuses are substantially the same and stackable with each other, with the enclosure of a first of the apparatuses being shaped to receive the top and at least part of the sides of the enclosure of a second of the apparatuses when stacking respective ones of the apparatuses together.

19. The apparatus as claimed in claim 14 wherein each of the sides of the enclosure has a proximal end and a distal end spaced-apart from the proximal end, the proximal ends of the sides of the enclosure connecting to the top of the enclosure, and wherein the apparatus has a plurality of longitudinally spaced-apart apertures extending through the sides of the enclosure, the apertures aligning adjacent to the distal ends of the sides of the enclosure.

* * * * *